United States Patent [19]

Armstrong

[11] 4,420,005

[45] Dec. 13, 1983

[54] WATER POWERED DISHWASHER

[76] Inventor: Daniel Armstrong, 1842 Harbor Pl., Naples, Fla. 33942

[21] Appl. No.: 438,011

[22] Filed: Nov. 1, 1982

[51] Int. Cl.[3] ..... B08B 3/02

[52] U.S. Cl. ..... 134/100; 134/179

[58] Field of Search ..... 134/93, 100, 101, 179

[56] References Cited

U.S. PATENT DOCUMENTS

| | | | |
|---|---|---|---|
| 1,314,622 | 9/1919 | Vaudreuil | 134/179 |
| 1,738,839 | 12/1929 | McClintock | 134/93 X |
| 2,244,301 | 6/1941 | Le Gore | 134/93 |
| 3,385,306 | 5/1968 | Brater et al. | 134/93 |
| 3,773,060 | 11/1973 | Byrd | 134/179 |
| 3,926,668 | 12/1975 | Ross | 134/179 |
| 3,934,822 | 1/1976 | Ross | 134/93 X |
| 3,961,984 | 6/1976 | Torressen | 134/100 |
| 4,298,015 | 11/1981 | Garza | 134/100 |

FOREIGN PATENT DOCUMENTS

| | | | |
|---|---|---|---|
| 658290 | 11/1963 | Italy | 134/100 |

*Primary Examiner*—Robert L. Bleutge
*Attorney, Agent, or Firm*—Merrill N. Johnson

[57] ABSTRACT

A unique water powered dishwasher having an improved rotatable spray arm and liquid detergent dispenser. The liquid detergent dispenser is located directly above the chamber which feeds water downwardly into the central hub of the spray arm. The rotatable spray arm is suspended from an axial shaft that also rotates and which is supported by the bottom of the liquid detergent dispenser, thus using liquid detergent as a lubricant to facilitate rotation of the spray arm. Water forced upwardly from the chamber leading to the spray arm lubricates the adjacent surfaces of the rotating hub and the stationary lower end of the chamber to further facilitate rotation of the spray arm. The top cover and base which contains the dishwasher have been designed for minimal storage space when not in use. The top cover, when inverted, will accept the bottom half of the dishwasher, thus requiring little storage space.

6 Claims, 4 Drawing Figures

WATER POWERED DISHWASHER

BACKGROUND AND SUMMARY OF THE INVENTION

I have invented a unique dishwasher powered solely by hot water flowing from a kitchen faucet. The dishwasher is designed to fit into a conventional kitchen sink and to wash the dishes and silverware used by one or two people during a meal. It is also designed so that when not in use, the entire dishwasher can be quickly disconnected and stored into a space of less than 1.2 cubic feet.

Water powered dishwashers have been proposed for many years. See, for example, U.S. Pat. Nos. 2,244,301; 3,385,306; 3,773,060; 3,926,668; 3,934,822 and 4,298,015. However, so far as I am aware, water powered dishwashers have not been successfully marketed.

By a radically different arrangement of the liquid detergent dispensing means and the rotatable spray arm, I have simplified the construction and improved the operation of water powered dishwashers. Less energy of the moving water is dissipated in rotating the spray arm and hence more water pressure is available for washing the dishes. An exactly metered quantity of liquid detergent is fed into the wash water during the initial washing cycle and when the liquid detergent is exhausted, a clear hot water rinsing cycle automatically follows.

All the user of my dishwasher has to do is load the dirty dishes and silverware into the dishwasher, add the desired amount of liquid detergent into the liquid detergent dispenser, put the cover onto the dishwasher, and turn on the hot water faucet. Then, when the dishwasher has gone through its sudsy water washing cycle and its clear hot water rinsing cycle, the user turns off the hot water faucet and allows the dishes and silverware to drain into the sink and air dry.

My dishwasher consists of three major sub-assemblies: a four-sided plastic base; a vinyl covered wire dishrack which fits inside the base and to which is attached the rotatable spray arm, the liquid detergent dispenser, and hose and piping leading from the water faucet to the spray arm; and a clear plastic cover which fits into a series of flanges in the upper rim of the base. The clear plastic cover is designed so that when it is inverted, the base and dishrack resting inside the base can be fitted into the inverted cover, thus requiring little storage space when not in use.

Other features which reduce its cost and increase its convenience are: the base has no bottom and instead water drains from the dishes directly into the sink, and almost all parts of the dishwasher are made of plastic material such as styrene which is relatively light in weight, totally rustproof, and economical to manufacture.

BRIEF DESCRIPTION OF THE DRAWINGS

A preferred embodiment of my dishwasher is shown in the accompanying drawings in which.

DETAILED DESCRIPTION OF THE INVENTION

Figure 1:
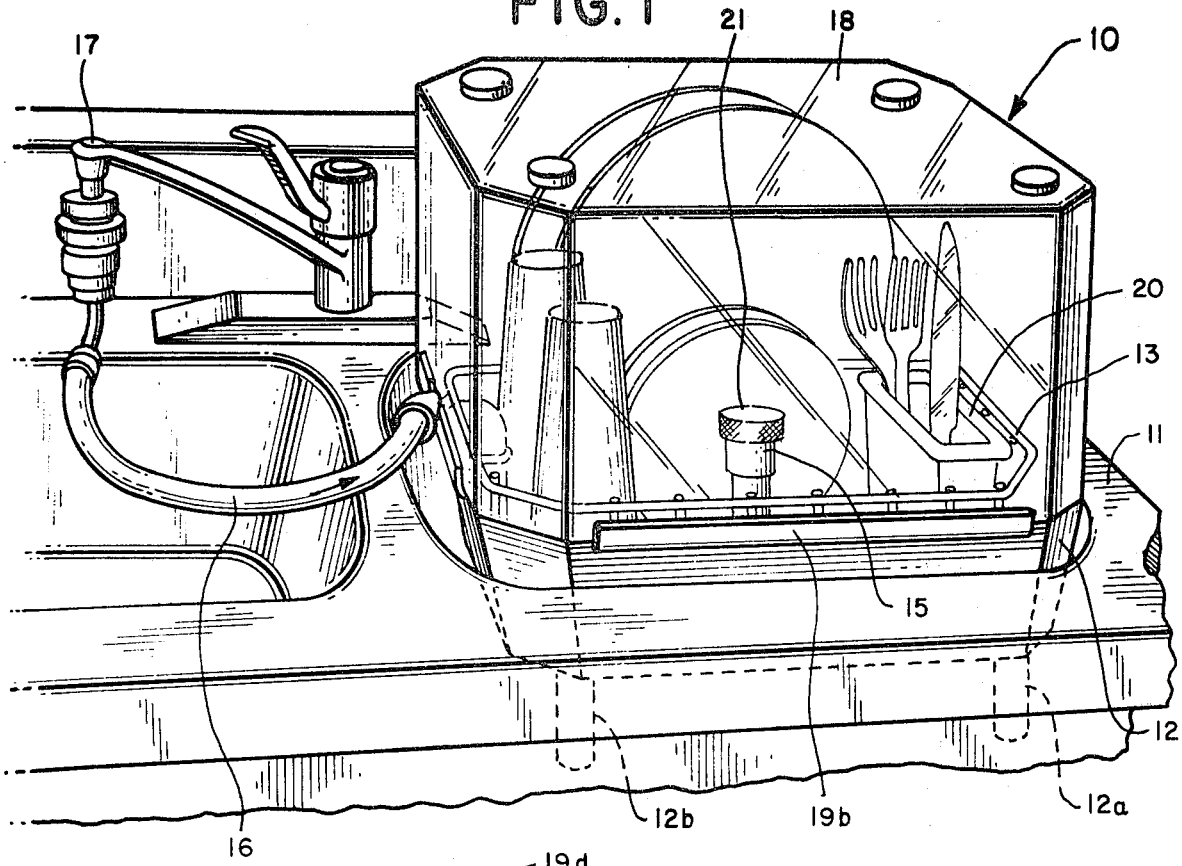
FIG. 1 is a perspective view of my dishwasher sitting in a kitchen sink and connected to the sink's water faucet.

In FIG. 1 of the drawings a preferred embodiment of my water powered dishwasher 10 is shown sitting in one side of a conventional kitchen double sink 11. Dishwasher 10 comprises three sub-assemblies: a bottomless four-sided base 12 made of a plastic material such as styrene; a vinyl covered wire dishrack 13 onto which is mounted a rotatable spray arm 14 (best shown in FIGS. 2 and 3), a liquid detergent dispenser 15 and a hose 16 and piping leading from a water faucet 17 to the spray arm 14; and a cover 18 made of a clear plastic material which fits over base 12 and dishrack 13 resting upon four flanges **19*a*, 19*b*, 19*c* and 19*d* on the rim of base 12**.

Dishwasher 10 is shown in FIG. 1 with the dishrack 13 filled with dirty dishes of one or two people from a typical meal including silverware segregated in a separate bin 20 mounted on one side of the dishrack. The dishrack rests on the upper rim of base 12 and during operation of the dishwasher is covered by clear plastic cover 18 resting on flanges **19*a–d* of base 12**.

Figure 2:
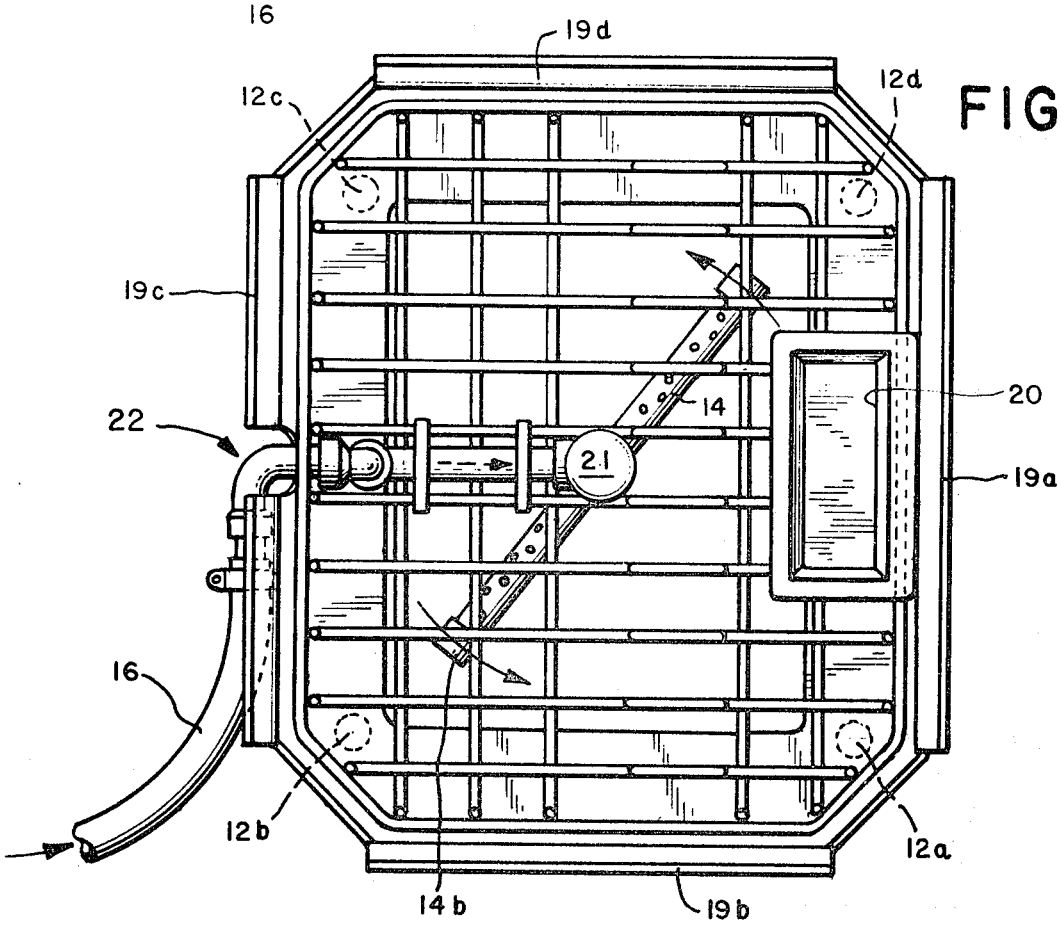
FIG. 2 is a plan view of my dishwasher with its cover removed showing the basket for holding the dishes and the bin for the silverware.

FIG. 2 shows the dishwasher without dishes or silverware in the rack and with cover 18 removed. This view shows the location of the four legs **12*a*, 12*b*, 12*c* and 12*d* which depend from base 12 and which rest upon the bottom of sink 11. FIG. 2 also shows spray arm 14 lying beneath the bottom of rack 13 and cap 21 which screws onto liquid detergent dispenser 15. Hot water from faucet 17 flows through hose 16 and piping shown generally in FIG. 2 by numeral 22 to rotatable spray arm 14**.

Figures 3, 4:
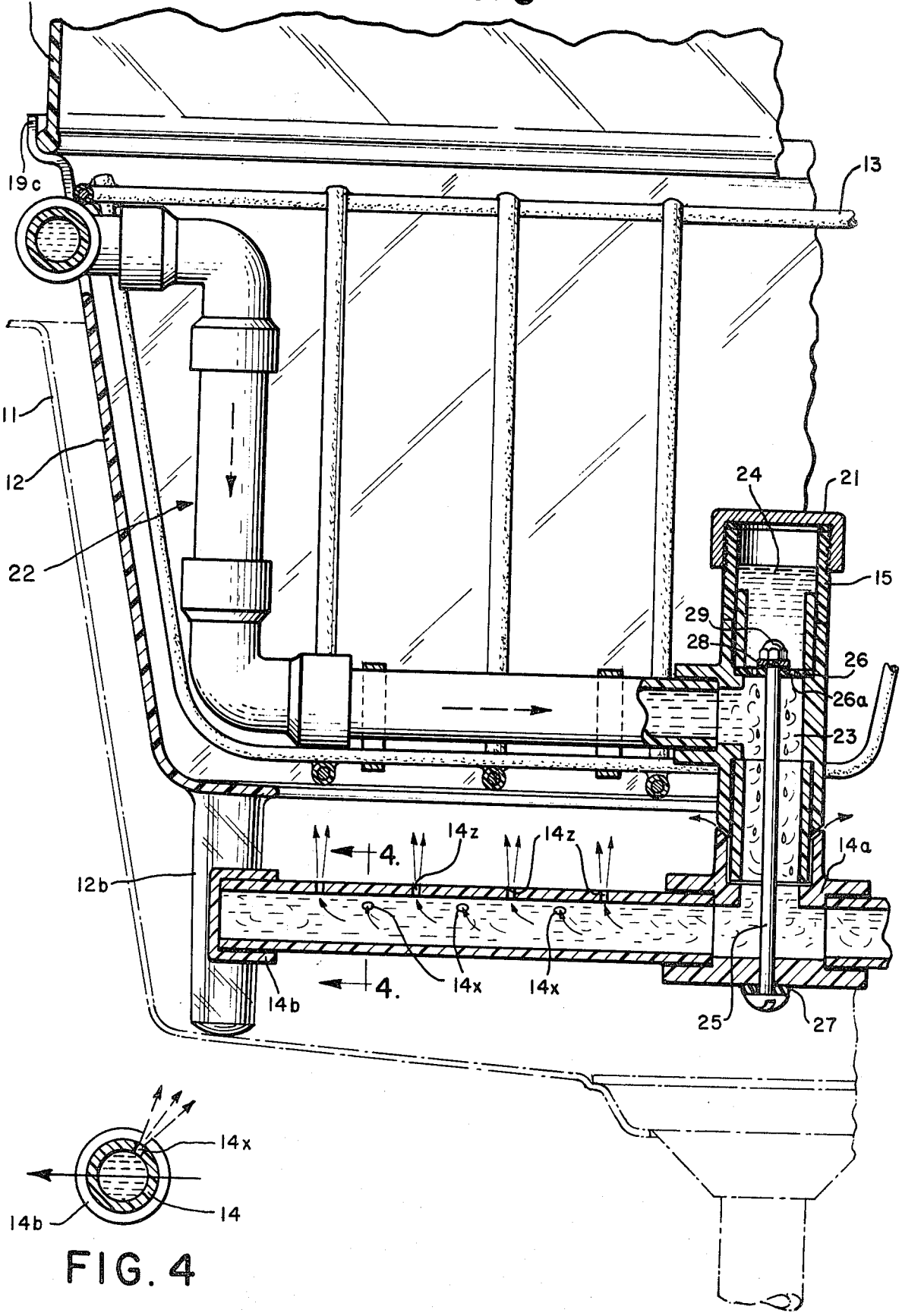
FIG. 3 is a side view partially broken away to show the operation of the liquid detergent dispenser and the mounting of the rotary spray arm.
FIG. 4 is a cross-sectional view of the spray arm taken along line 4—4 of FIG. 3.

FIG. 3 is partially broken away to show the construction and operation of the liquid detergent mixing chamber and the mounting and rotation of the spray arm. Arm 14 is made of plastic tubing and includes a T-shaped central hub **14*a* and two cylindrical end caps 14*b*. Two series of holes are drilled in the two pieces of plastic tubing of arm 14. The first series designated as holes 14*x* in FIGS. 3 and 4 are so located on arm 14 that the reaction pressure of the water jets from holes 14*x* will cause a rapid rotation of spray arm 14**.

The second series designated holes **14*z* in FIG. 3 are located at the top of the spray arm to spray jets directly up onto the surfaces of the dishes and silverware in rack 13. Of course, the water jets from both holes 14*x* and 14*z* will combine to wash the contents of rack 13**.

Spray arm 14 is mounted on a stainless steel bolt 25 which is suspended from the bottom 26 of liquid detergent dispenser 15. The head of bolt 25 rests against an O-ring 27 which supports hub **14*a*. The upper threaded end of bolt 25 passes through an axial hole in bottom 26 and a stainless steel washer 28 and is retained by a stainless steel nut 29. Bottom 26 of the liquid detergent dispenser 15 contains a plurality of small holes 26*a* surrounding washer 28. These holes permit liquid detergent 24 from dispenser 15 to flow into mixing chamber 23 located directly below dispenser 15**.

Hose 16 includes a conventional snap-on connection for fastening the hose to water faucet 17 as shown in FIG. 1. When hose 16 is connected to the faucet, hot water from faucet 17 will flow through hose 16 and piping 22 into mixing chamber 23 where the flowing water picks up liquid detergent. The supply of liquid detergent 24 is dispensed into mixing chamber 23 first by gravity and then by the rate at which water displaces the liquid detergent leaving the liquid detergent dispenser 15. The actual washing time is thus regulated by the available water flow.

The upper edge of rotatable hub 14*a* and the adjacent lower edge of stationary dispenser 15 are beveled at about 45° as shown in FIG. 3. The length of bolt 25 is such that the upper beveled edge of hub 14*a* and the adjacent parallel lower edge of dispenser 15 form a narrow passageway which, when the dishwasher is in operation, receives a flow of hot water from mixing chamber 23. This water is discharged from the passageway between hub 14*a* and dispenser 15 as shown by the arrows in FIG. 3. This function inhibits any binding action which might occur during rotation of the spray arm 14, and simultaneously provides additional washing action.

The location of the liquid detergent dispenser 15 axialy above the spray arm 14 is designed so that when spray arm 14 is forced to rotate by the opposite reaction pressure of water jets 14*x*, the stainless steel nut 29 simultaneously rotates against the stationary stainless steel washer 28. Nut 29 and washer 28 act as a bearing, which is lubricated by the liquid detergent 24 in dispenser 15.

The amount of liquid detergent required for an average load of dirty dishes and silverware is approximately one-half ounce. The approximate sudsy water washing time is one to three minutes, depending upon the amount of liquid detergent used and the available water pressure. The clear water rinsing time varies until all suds are dissolved as seen through the clear cover 18. The water used should be hot enough to activate the detergent and aid in rapid evaporation of the rinse water for drying. Cold water may be used for the rinse cycle.

This portable dishwasher will be useful in almost every household kitchen or home bar. Left in one side of a double sink as shown in FIG. 1, it can be quickly attached to wash a "quick load" for immediate use. This cannot be accomplished conveniently by an under-the-counter type dishwasher.

Whether my dishwasher is used to wash a small load of dishes as described or used as a conventional drain rack either in the sink or in its "stored" position on the countertop, it is a marked improvement over previously suggested water powered dishwashers and conventional drain racks.

While I have shown and described a preferred embodiment of my water powered dishwasher, certain modifications and changes in construction will be apparent to those skilled in the art. Accordingly, my invention is limited only by the spirit and scope of the appended claims.

I claim:

1. A water powered dishwasher comprising a four-sided base;

a four-sided dishrack lying within said base and removably supported by the upper rim of said base;

a water and liquid detergent mixing chamber located at the center of said dishwasher and mounted on said dishrack;

a rigid pipe mounted on said dishrack, one end of said pipe being connected to a flexible hose leading to a water faucet and the other end of said pipe being connected to said mixing chamber;

a dispenser for storing and dispensing a quantity of liquid detergent lying axially above and communicating with said mixing chamber;

a rotatable spray arm mounted beneath said dishrack, said arm including a T-shaped central hub connected to and lying axially beneath said mixing chamber and a plurality of tubular arm segments extending from said hub; and a clear plastic dome-shaped cover whose lower edge rests upon flanges extending from the upper rim of said base.

2. A water powered dishwasher according to claim 1 in which the rotatable spray arm is mounted on the lower end of a vertical shaft which depends through the mixing chamber and is supported from the bottom of the liquid detergent dispenser.

3. A water powered dishwasher according to claim 1 in which the rotatable spray arm is mounted on a vertical shaft which is supported from a washer resting on the bottom of the liquid detergent dispenser.

4. A water powered dishwasher according to claim 1 in which the cover is so shaped that when it is inverted, the base and its supported dishrack and other components of the dishwasher can be inserted into and supported in said inverted cover.

5. A water powered dishwasher according to claim 1 in which the base is made of a plastic material and has an open bottom and the base rests upon four legs also made of a plastic material depending from the four corners of the base.

6. In a dishwasher having a rotatable spray arm, a dispenser for storing and dispensing a quantity of liquid detergent and a mixing chamber for mixing water and liquid detergent, the improvement which comprises the vertical axial alignment of the liquid detergent dispenser, the mixing chamber and the rotatable spray arm so that liquid detergent is fed downwardly with the aid of gravity into the mixing chamber and the resulting sudsy water flows downwardly directly into the rotatable spray arm.

* * * * *